United States Patent [19]

Case

[11] 4,200,942

[45] May 6, 1980

[54] TOWEL HAVING INFLATABLE PILLOW INCORPORATED THEREIN

[76] Inventor: Marianna Case, 4308 Via Marina, No. B, Marina Del Rey, Calif. 90291

[21] Appl. No.: 955,656

[22] Filed: Oct. 30, 1978

[51] Int. Cl.[2] ..... B32B 1/06; B32B 3/02

[52] U.S. Cl. ..... 5/419; 5/449; 428/35; 428/178; 428/190

[58] Field of Search ..... 428/174, 35, 178, 80, 428/190; 5/337, 341, 344, 365, 417, 419, 448, 449, 485; D6/265

[56] References Cited

U.S. PATENT DOCUMENTS

| | | | |
|---|---|---|---|
| 2,264,471 | 2/1941 | Glenn | 5/344 |
| 3,176,315 | 4/1965 | Freund | 5/344 |
| 3,689,947 | 9/1972 | Wolf | 5/344 |

*Primary Examiner*—Paul Thibodeau

*Attorney, Agent, or Firm*—Edward A. Sokolski

[57] ABSTRACT

An elongated towel has a flap member attached thereto near one end thereof, this flap member forming a compartment for removably receiving an inflatable pillow. The towel thus can be used for the usual drying purposes and also as a mat for sun bathing with the inflatable pillow forming a headrest.

4 Claims, 6 Drawing Figures

TOWEL HAVING INFLATABLE PILLOW INCORPORATED THEREIN

This invention relates to a towel device, and more particularly to such device having a headrest incorporated therein.

Large beach and pool towels generally serve both for drying purposes and as a "mat" for sun bathing. When used for the latter purpose, the user either foregoes the convenience of a headrest or forms a makeshift headrest out of available articles of clothing, etc., which is usually somewhat inadequate. Of course, to assure optimum comfort, one can take an air mattress to the beach or pool, but this necessitates carrying one more article, and air mattresses are often cumbersome and bulky to handle.

The device of the present invention overcomes the aforementioned shortcomings by providing a towel device which has little more bulk than a large bath towel and provides the added feature of a comfortable headrest when the towel is used for sunbathing. The device is relatively simple, compact and economical in its construction, yet it affords the user the luxury of a full pillow.

This end result is achieved by attaching a flap member forming a compartment to a towel near one end thereof, this flap member compartment having a slit formed on one side thereof through which a deflated air pillow can be inserted into the compartment and removed therefrom. The inflation valve for the pillow fits through this slit, so that it can readily be inflated or deflated by the user.

It is therefore an object of this invention to provide a towel device which can be dually used for both drying purposes and as a mat having a headrest.

It is a further object of this invention to provide a compact, economical towel-mat device which incorporates an inflatable pillow.

Other objects of this invention will become apparent as the description proceeds in connection with the accompanying drawings of which FIG. 1 is a top plan view of a preferred embodiment of my invention;

Figure 1:
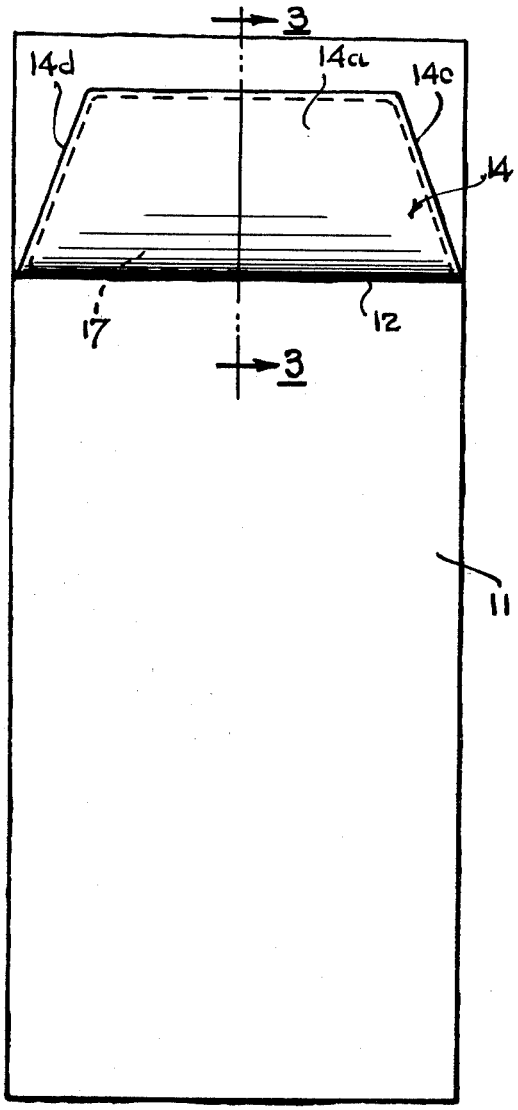
Figure 2:
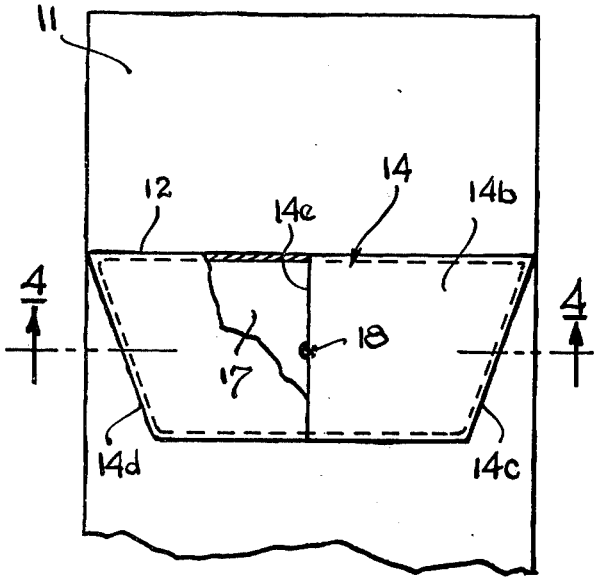
FIG. 2 is a top plan view showing the upper portion of the preferred embodiment with the headrest portion flipped over.
Figure 4:
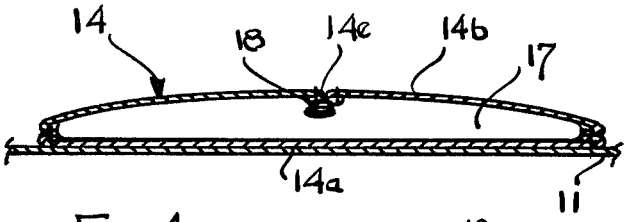
FIG. 4 is a cross-sectional view taken along the plane indicated by 4—4 in FIG. 2.
Figure 6:
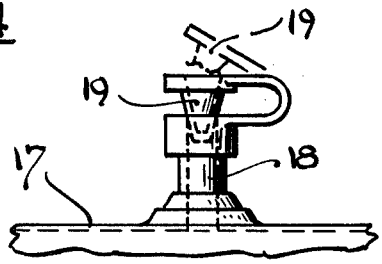
FIG. 6 is an elevational view illustrating the inflation valve for the inflatable pillow employed in the preferred embodiment.
Figure 3:
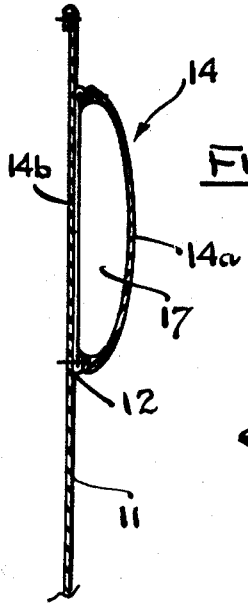
FIG. 3 is a cross-sectional view taken along the plane indicated by 3—3 in FIG. 1.
Figure 5:
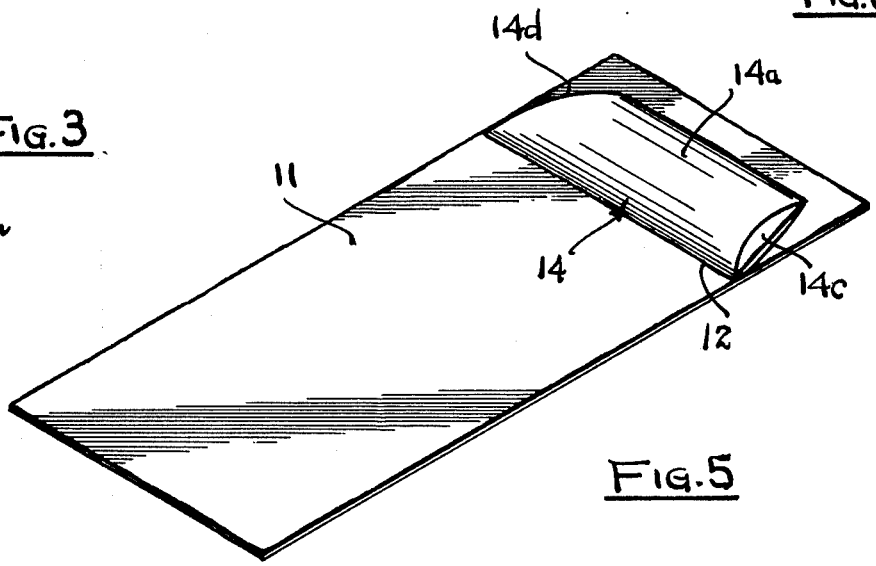
FIG. 5 is a perspective view of the preferred embodiment.

Referring now to the figures, a preferred embodiment of the invention is illustrated. The main body portion 11 of the device is fabricated of a suitable water absorbent, washable towel material, such as terrycloth, and is preferably of a rather large size, e.g. of the order of 6' by 3'. Fixedly attached to the main body 11 of the towel along a lateral seam line 12 parallel to the top and bottom edges of main portion 11 and perpendicular to the side edges thereof is a flap member 14 which has top, bottom and side wall portions **14*a*–14*d* to form a compartment. Flap member 14 is trapezoidal in shape and is preferably made of the same material as the main body portion 11** of the device. The bottom wall portion **14*b* of the compartment has a lateral slit 14*e* formed therein, this slit running along most of the width of wall portion 14*b*. The slit 14*e* is used for inserting an inflatable pillow 17 inside the compartment 14. The pillow 17 may be of a material such as polyvinyl and has an inflation valve 18 and a stopper member 19** for sealing the valve once it is properly inflated.

When the device is being carried or otherwise transported, or when it is in use for drying oneself, the pillow 17 is kept deflated so that the device can be folded up and is no bulkier than an ordinary beachtowel. Before laundering, the pillow can be removed from compartment 14. When the device is to be used for sunbathing, the pillow can be easily inflated by mouth to the desired inflation level, and when such use has ended, rapidly deflated to make for the original compact package. In view of its compactness, the device of the invention is particularly suited for travel in that it occupys little space and adds very little weight to a suitcase.

While the invention has been described and illustrated in detail, it is to be clearly understood that this is intended by way of illustration and example only and is not to be taken by way of limitation, the spirit and scope of this invention being limited only by the terms of the following claims.

I claim:

1. A towel device having a pillow incorporated therein comprising:

an elongated main body portion fabricated of a washable, moisture-absorbent material, a flap member attached to said main body portion solely along a seam line running across said main body portion at a position spaced between a pair of opposite ends thereof and towards one of said ends, said flap member having side, top and bottom wall portions which are joined together to form a compartment, a slit being formed in the bottom wall portion, said main body portion extending in opposite directions from said seam line separate and apart from said flap member whereby said flap member is adapted to be alternatively positioned with the bottom wall portion thereof abutting against a part of the main body portion between said one of said ends thereof and said seam line or the top wall portion thereof abutting against a part of the main body portion between the other of said pair of ends thereof and said seam line, and an inflatable pillow installed within said compartment, said compartment slit being adapted to pass said pillow in its deflated state from the outside of said compartment to the inside thereof and vice versa, but not to pass said pillow therethrough in its inflated state, said pillow having an inflation valve which is located along said compartment slit.

2. The towel device of claim 1 wherein said flap member is attached to the main body portion along a seam line which is substantially parallel to the shorter edges of said main body portion and perpendicular to the longer edges of said main body portion.

3. The towel device of claim 2 wherein said slit runs substantially normal to the shorter edges of the main body and substantially parallel to the longer edges of the main body portion.

4. The towel device of claim 1 wherein the flap member has a trapezoidal shape.

* * * * *